United States Patent [19]

Froment et al.

[11] Patent Number: 4,534,385

[45] Date of Patent: Aug. 13, 1985

[54] LEVELING DEVICE FOR WEAVING MECHANISMS INCORPORATING CAMS OF THE NEGATIVE TYPE

[76] Inventors: Jean-Paul Froment, La Creuse Sud - Doussard, FR 74210 Faverges; Louis P. Houlon, Duingi, FR-74410 Saint Jorioz, both of France

[21] Appl. No.: 535,091

[22] Filed: Sep. 23, 1983

[30] Foreign Application Priority Data

Oct. 20, 1982 [FR] France ..... 82 17843

[51] Int. Cl.[3] ..... D03C 5/00; D03C 1/00; D03C 13/00

[52] U.S. Cl. ..... 139/79; 139/66 R; 139/82

[58] Field of Search ..... 139/79, 80, 81, 66 R, 139/82, 84, 88, 55.1

[56] References Cited

U.S. PATENT DOCUMENTS 4,314,588 2/1982 Speich ..... 139/79

FOREIGN PATENT DOCUMENTS 245308 1/1926 United Kingdom ..... 139/66 R
568193 3/1945 United Kingdom ..... 139/79
792458 3/1958 United Kingdom ..... 139/79
316785 1/1972 U.S.S.R. ..... 139/82

*Primary Examiner*—James Kee Chi
*Attorney, Agent, or Firm*—Dowell & Dowell

[57] ABSTRACT

The invention relates to a levelling device for weaving mechanisms incorporating cams of the negative type. With each oscillating lever there is associated a tipping pawl adapted, under the effect of a control member common to all the pawls, to bear yieldably against the edge of the lever in question and to cooperate with a retaining stop formed thereon. Under these conditions, it is the weaving mechanism itself which furnishes the effort of levelling the heddle frames.

2 Claims, 6 Drawing Figures

LEVELING DEVICE FOR WEAVING MECHANISMS INCORPORATING CAMS OF THE NEGATIVE TYPE

The present invention relates to weaving mechanisms for the formation of the shed in weaving looms and it relates more particularly to mechanisms incorporating cams of negatve type, i.e. those in which the heddle frames are displaced positively, against elastic return means which ensure their return to a position of rest, by oscillating levers controlled by said cams which are suitably profiled rotating cams.

It is known that for certain operations on the loom, particularly when initially assembling the lap of warp yarns, it is necessary to bring all the heddle frames to the same level. Different devices have been proposed for this levelling operation, these devices acting either directly on the oscillating levers which are in rest position so as to bring them to the work position against the elastic return means, or acting on the spindle which ensures articulation of the assembly of the oscillating levers with a view to displacing it transversely to allow all of said levers to tip into rest position despite their abutment against the cams. It will be readily appreciated that, in both cases, these are relatively complex systems which, in addition, employ considerable power to overcome the action of the elastic return means to which is added the tension of the warp yarns.

It is a principal object of the present invention to overcome these drawbacks by providing that the weaving mechanism itself take over the effort of levelling.

This invention essentially consists in associating with each of the oscillating levers of the mechanism a loaded pawl capable, by tipping under the effect of a control member common to all the pawls, of bearing against the edge of the corresponding lever and of cooperating with a retaining stop formed on said edge when this lever reaches an angular end of stroke position in the course of operation of the mechanism.

Figure 1:
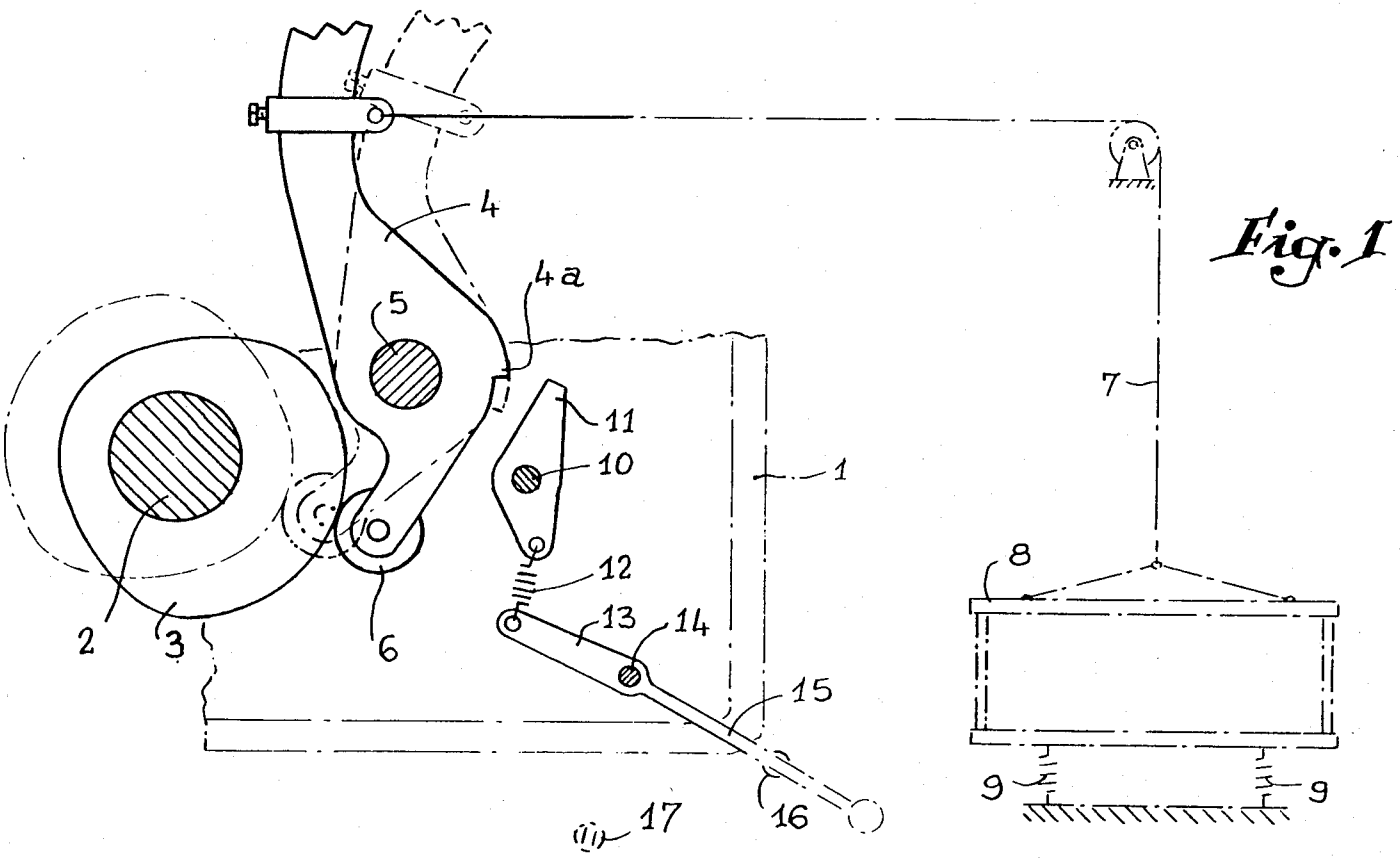

The invention will be more readily understood on reading the following description with reference to the accompanying drawings, in which:

FIG. 1 is a vertical section illustrating the general arrangement of a levelling device according to the invention.

Figure 2:
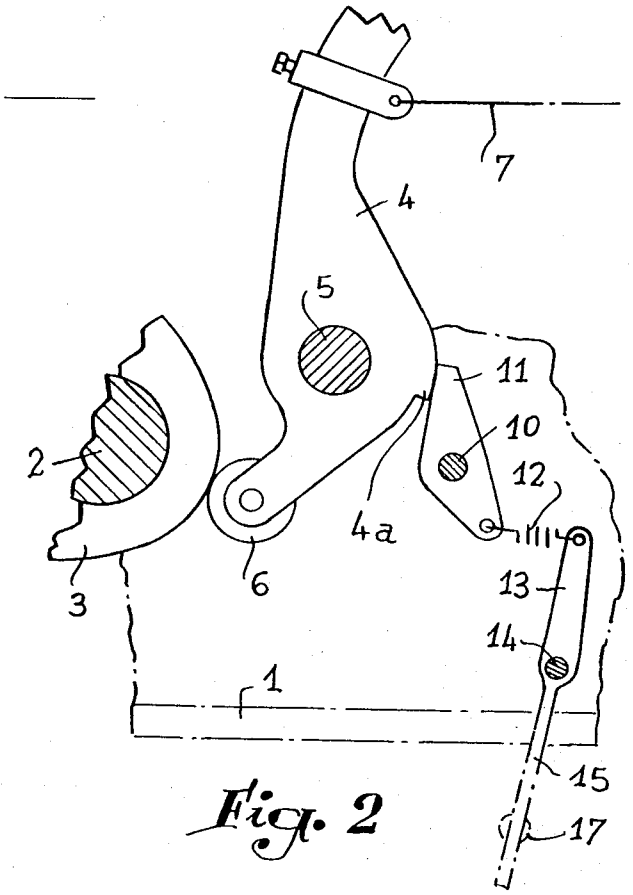
Figure 3:
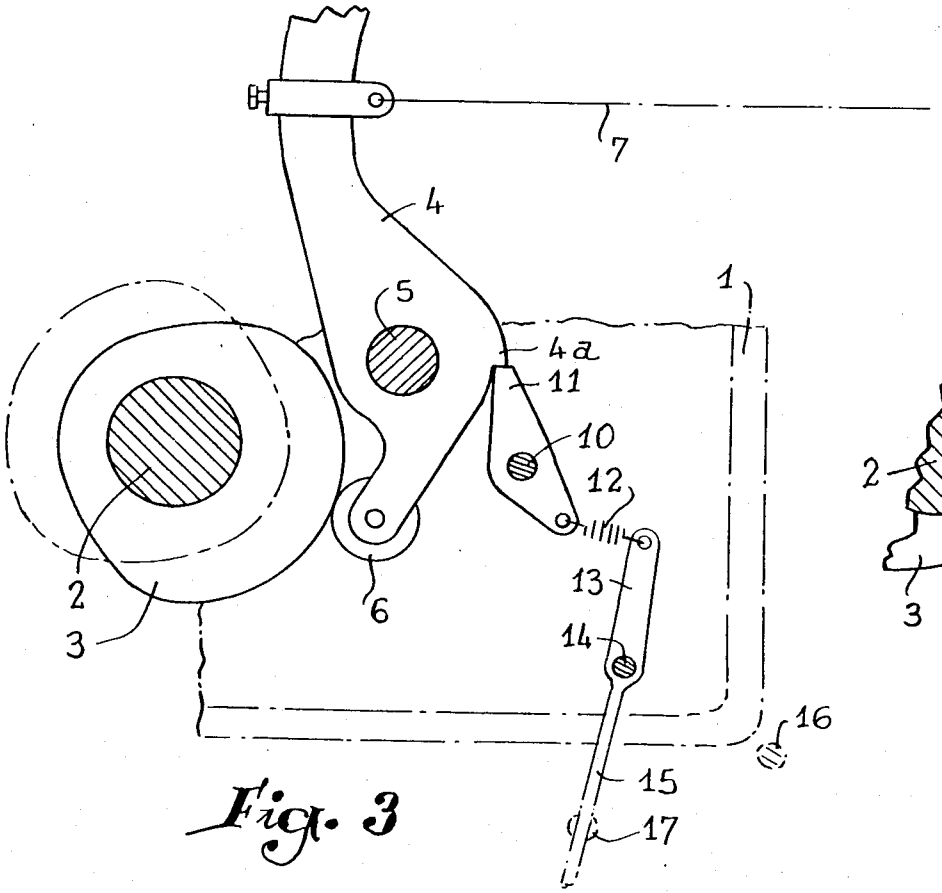

FIGS. 2 and 3 reproduce FIG. 1 in two other mechanism positions.

Figure 4:
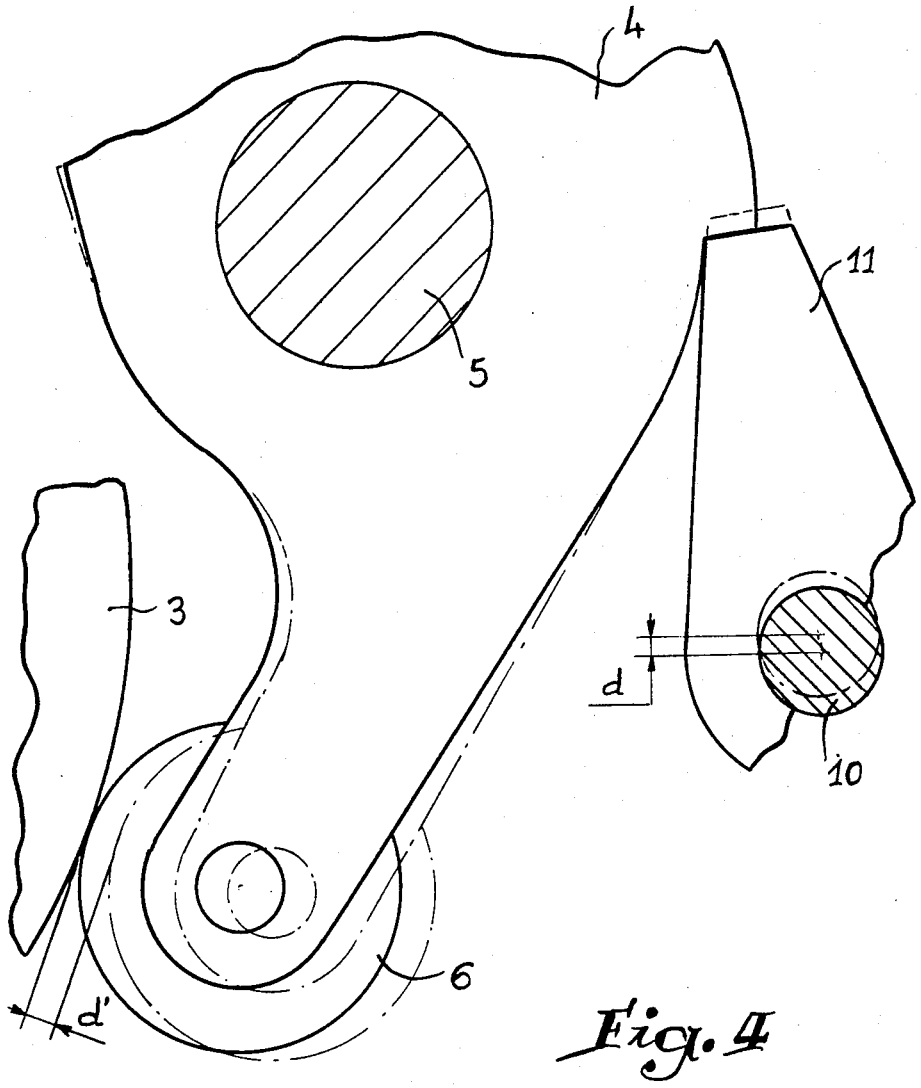

FIG. 4 is a section in detail, on a larger scale, illustrating a way of eliminating from the locking means the clearance necessary for normal operation of the levelling device.

Figure 5:
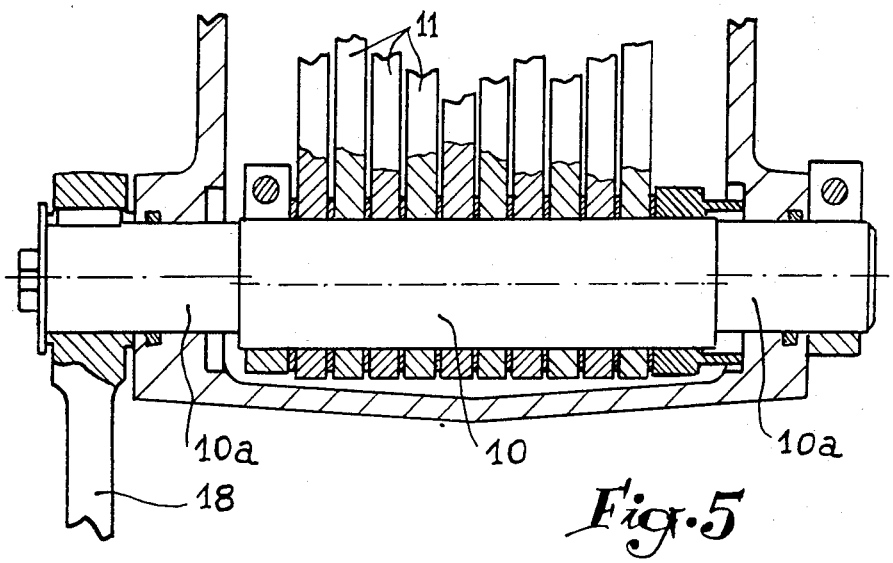
Figure 6:
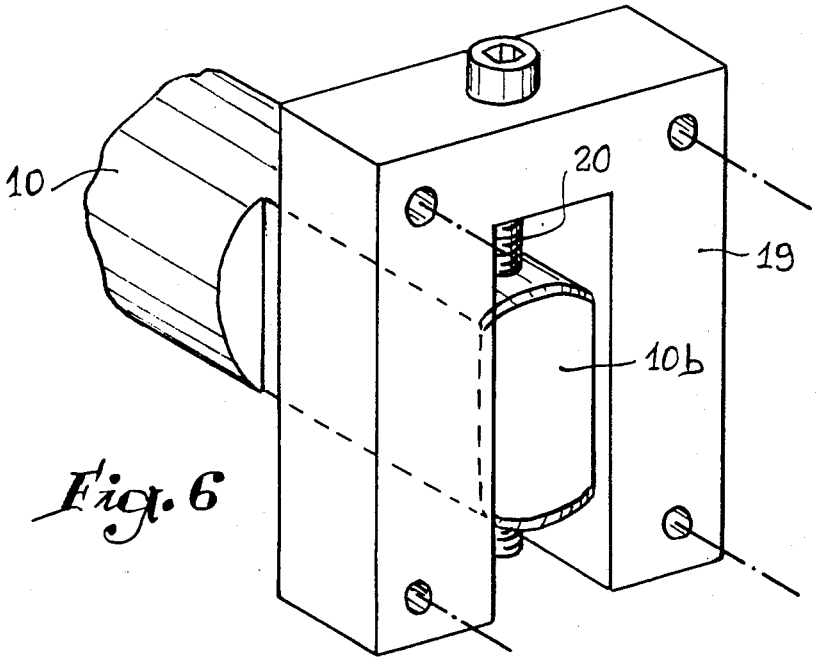

FIGS. 5 and 6 schematically show two embodiments of a mechanism adapted to obtain the action envisaged in FIG. 4.

Referring now to the drawings, the particular weaving loom mechanism shown in FIG. 1 comprises a housing 1 inside which rotates a shaft 2 on which is fixed a series of cams or eccentrics 3 for actuating an corresponding number of oscillating levers 4. These levers 4 are pivotally mounted side by side on a spindle 5 oriented parallel to the shaft 2 and each of them bears at its lower end a cam follower roller 6. On the opposite end of each oscillating lever 4 is attached a cable 7 at the end of which is fixed one of the heddle frames 8 which yieldable means, shown in the form of springs 9, tend to lower in the direction of the ground.

This is the conventional arrangement of a weaving mechanism incorporating cams of negative type, so that no detailed explanation thereof is necessary. It will be readily appreciated that the return action exerted by the springs 9 ensures the yieldable application of the rollers 6 against the cams 3 of the shaft 2, so that, when the latter is actuated by a movement of rotation, said cams effect tipping of the different levers 4 according to a programme which obviously depends on the mutual setting of said cams on the shaft 2. This tipping naturally produces the vertical displacement of the frames 8 which are lifted under the action of the cams and are lowered under the effect of the springs 9.

The levelling device according to the invention comprises a spindle 10 oriented parallel to the shaft 2 so as to form a pivot for a series of pawls 11, in number equal to the number of oscillating levers 4. Each pawl 11 is connected by a yieldable spring 12 to a small arm 13 rendered angularly fixed to a lower shaft 14 common to all of said arms 13. This shaft 14 is pivotally controlled with the aid of a control member 15 accessible from outside the housing 1, which member cooperates selectively with one or the other of two positioning detents 16 and 17. Furthermore, it will be observed that the edge of each oscillating lever which faces the pawls 11 is sectioned or cut out to present a stop **4*a***.

During normal operation of the weaving mechanism, the control member 15 is oriented in the position illustrated in FIG. 1 wherein it is retained by the detent 16. The pawls 11 are disposed, in unlocked position so that they cannot intefere with the oscillating levers 4.

On the other hand, when it is desired to level the frames 8, it suffices to displace the control member 15 angularly with a view to bringing it into the orientation of FIGS. 2 and 3 in which said member is retained by detent 17. Due to the link ensured by springs 12, the pawls 11 are suddenly yieldably applied against the edge of the oscillating levers 4, in the manner shown in FIG. 2. Under these conditions, it will be readily appreciated that, as soon as the cams 3 cause the levers 4 to pivot and raise the frames 8 in the course of rotation of the shaft 2, the upper end bearing surface of the pawl 11 corresponding to that particular cam 3 will move toward locked position and engage beneath the stop **4*a* of the arm 4 shown in (FIG. 3), so that said lever is retained in the high position raising its frame 8**.

All the frames are thus successively brought into and locked in high position by the weaving mechanism itself, without the operator having to make any effort other than the control effort required to cause the simple momentary deformation of the connecting springs 12 to urge the pawls 11 from one position to the other. Moreover, the member 15 may be displaced at any moment during normal operation of the mechanism.

It should be observed that stops **4*a* are positioned on levers 4 so that locking of the pawls 11 as set forth hereinabove occurs very slightly before said levers attain their total lift stroke. Under these conditions, rotation of shaft 2 and of cams 3 imparts a further very slight oscillation to levers 4, thus creating a clearance between pawls 11 and stops 4*a*, which clearance allows withdrawal of said pawls under the action of said cams as soon as the operator has returned member 15 to the initial position of FIG. 1. The levers 4** are then released and the weaving mechanism may resume normal operation.

When the mechanism is locked in the position of levelling shown in FIG. 3, the oscillating levers 4 whose rollers 6 are in contact with the part of largest radius of the corresponding cam 3, are oriented, due to the clearance mentioned above, very slightly differently from the levers which are retained by the pawls 11. In the large majority of cases, this very slight difference is of no practical importance, but if it is desired to make very precise adjustments requiring an absolutely perfect levelling of the heddle frames, the system illustrated in FIG. 4 may be employed.

According to this system, a mechanism adapted to ensure its transverse displacement over a very short distance d is associated with the spindle 10 which constitutes the common pivot of all the pawls 11. Consequently, pawls 11 act in the manner of pushers with respect to the oscillating levers 4, so that the latter all pivot about shaft 5 and the peripheries of their rollers 6 moves away from the peripheries of cams 3 by distance d'. It will be readily appreciated that this distance d' is greater than the said clearance, all the levers being located in an absolutely identical angular position, so that all the heddle frames are at the same height.

This action on the pawls 11 is of course not powered by the mechanism itself and therefore requires a manual effort. However, it is effected only in exceptional cases. Furthermore, the distance of thrust d is very short, of the order of some tenths of millimeter only. In particular, the mechanism adapted to effect transverse displacement of the spindle 10 is capable of incorporating a reducing gear system, as has been assumed in FIGS. 5 and 6 which illustrate two embodiments of such a mechanism. In FIG. 5, the spindle 10 is provided with two ends 10*a* very slightly offset i.e. eccentric with respect to the central part which bears the pawls 11, so that the angular displacement imparted to said spindle with the aid of a manoeuvring member such as 18 provokes the desired transverse displacment d. In FIG. 6, each of the ends, referenced 10*b*, of the spindle 10 is sectioned to slide in fixed transverse guides 19 when the operator rotates screws or like members 20.

Other forms of embodiment may be imagined. Angular control of pawls 11 may be ensured in any appropriate manner, the disposition incorporating the connecting springs 12 having been taken into consideration only by way of illustration.

What is claimed is:

1. In a weaving loom of the negative cam type having multiple oscillating levers each connected to a heddle frame, and the weaving loom having multiple cams each operative to displace an oscillating lever to raise an associated heddle frame which is yieldably returned toward lowered position, a leveling device comprising:

a stop on each oscillating lever;

a pawl pivotally supported opposite each lever stop, each pawl being pivotable between an unlocked position out of contact with its associated lever and a locked position in which it engages the lever and locks the stop when the lever is displaced by a cam;

a control member selectively operable between first and second control positions; and separate yieldable means for each pawl, each yieldable means being connected between its pawl and the control member, said yieldable means all being operative when the control member is in its first position to urge their associated pawls into their unlocked positions and being operative when said control member is in its second position to urge the associated pawls against their oscillating levers, whereby as the levers are displaced by the cams to raise the heddles the pawls will engage the stops of the engaged levers and lock the levers to hold the heddle frames in their raised positions.

2. The weaving loom leveling device of claim 1, wherein each oscillating lever has a cam follower normally engaging an associated cam, and wherein said pawls are all pivotally supported on a common spindle, said leveling device further comprising means operable when the oscillating levers are locked by the pawls for displacing the common spindle in a direction to displace all the pawls to rotate the levers sufficiently to disengage all their cam followers from the associated cams.

* * * * *